US005683035A

United States Patent [19]

Wang

[11] Patent Number: 5,683,035

[45] Date of Patent: Nov. 4, 1997

[54] SPRINKLING SEAT STRUCTURE FOR A LAWN

[75] Inventor: King-Yuan Wang, Changhua Hsien, Taiwan

[73] Assignee: Yuan Mei Corporation, Changhua Hsien, Taiwan

[21] Appl. No.: 571,774

[22] Filed: Dec. 13, 1995

[51] Int. Cl.[6] ..... B05B 1/12; B05B 1/16; A62C 31/02

[52] U.S. Cl. ..... 239/394

[58] Field of Search ..... 239/222.13, 222.21, 239/225.1, 230, 231, 232, 233, 246, 247, 248, 273, 279, 280, 390, 391, 394, 392; D23/214

[56] References Cited

U.S. PATENT DOCUMENTS

| | | | |
|---|---|---|---|
| 3,081,950 | 3/1963 | Rinkewich | 239/394 |
| 4,347,981 | 9/1982 | Hayes | 239/394 |
| 5,566,886 | 10/1996 | Wang | 239/394 |
| 5,598,978 | 2/1997 | Wang | 239/394 |

*Primary Examiner*—Andres Kashnikow
*Assistant Examiner*—Robin O. Evans
*Attorney, Agent, or Firm*—Bacon & Thomas

[57] ABSTRACT

A sprinkling seat structure for a lawn, including a circular frame seat, a connecting disk and a sprinkling rotary cover. The circular frame seat includes a circular peripheral frame and a central water-outgoing seat connected with the peripheral frame by several radial connecting ribs. A connector is disposed on one side of the water-outgoing seat for connecting with a water-incoming tube. The water-outgoing seat is formed with a water-outgoing opening for communicating with the connector. The connecting disk is formed with a central hollow downward projecting fixing boss. A free end of the fixing boss is formed with an inclined face having an annular groove. Several circular holes are formed around the fixing boss. The sprinkling rotary cover has a central sprinkling dome formed with multiple sprinkling meshes. Multiple sprinkling holes with various patterns and two opposite close holes are disposed around the sprinkling dome. The rotary cover is formed with a peripheral inclined face having multiple sprinkling meshes. Multiple circular surrounding walls are disposed on inner face of the rotary cover respectively corresponding to the sprinkling holes. A first C-shaped surrounding wall open to inner side and a second C-shaped surrounding wall open to outer side are disposed on inner face of the rotary cover respectively corresponding to the first and second close holes. The circular and C-shaped surrounding walls are connected by connecting walls.

2 Claims, 5 Drawing Sheets

SPRINKLING SEAT STRUCTURE FOR A LAWN

BACKGROUND OF THE INVENTION

The present invention relates to a sprinkling seat structure for a lawn, including a circular frame seat, a connecting disk and a sprinkling rotary cover. Multiple circular surrounding walls are disposed on inner face of the rotary cover respectively corresponding to sprinkling holes of the rotary cover. A first C-shaped surrounding wall open to inner side and a second C-shaped surrounding wall open to outer side are disposed on inner face of the rotary cover respectively corresponding to a first and a second close holes of the rotary cover. The circular and C-shaped surrounding walls are connected by connecting walls to partition interior space of the rotary cover into an outer compartment and an inner compartment. In tile case that the first C-shaped surrounding wall is aligned with the water-outgoing opening, the water is restricted within the inner compartment of the rotary cover and sprinkled outside from the sprinkling meshes of tire central sprinkling dome. In the case that the second C-shaped surrounding wall is aligned with the water-outgoing opening, the water is restricted within the outer compartment of the rotary cover and sprinkled outside the sprinkling meshes of the peripheral inclined face. Therefore, in addition to the sprinkling holes with various sprinkling patterns, two more sprinkling patterns are provided.

FIGS. 1 and 2 show a conventional sprinkling seat structure for a lawn, including a bottom casing 10 and a sprinkling cover 20. A connector 11 is disposed on one side of the bottom casing 10 and a circular projection is formed on upper surface of the bottom casing 10 to define a platform 12. A connecting hole 13 is formed on a central portion of the platform 12. A water-incoming opening 14 is formed beside the connecting hole 13 to communicate with the connector 11. A water-outgoing cap 141 having a water-sealing ring is fitted in the water-incoming opening 14. A water-sealing washer 142 is additionally rested on the water-outgoing cap 141. A mountain-like locating rib 15 is disposed on one side of the connecting hole 13 opposite to the water-incoming opening 14. An engaging recess 151 is formed on the tip of the locating rib 15.

The sprinkling cover 20 has the same shape and size as the circular platform 12. Multiple sprinkling holes 21 with various patterns are arranged along the periphery of the sprinkling cover 20. Several engaging legs 22 with hook-like lower ends are disposed around a central portion of the lower face of the sprinkling cover 20. Several radial stopper walls 23 are disposed between the sprinkling holes 21 to divide the interior space of the sprinkling cover 20 into several compartments.

When assembled, the engaging legs 22 of the sprinkling cover 20 are compressed and inserted into the connecting hole 13 of the bottom casing 10 with the hook-like lower ends resiliently engaged therewith as shown in FIG. 3. When the sprinkling cove, 20 is rotated, one of the stopper walls 23 climbs up the locating rib 15 to be located in the engaging recess 151 thereof. At this time, the sprinkling hole 21 opposite to the stopper wall is aligned with the water-incoming opening 14. Therefore, the water can flow through the connector 11 and the water-incoming opening 14 to be sprinkled outside from the sprinkling hole 21.

Several shortcomings exist such conventional sprinkling seat structure as follows:

1. When the stopper wall 23 climbs up the locating rib 15, the stopper wall 23 will suffer frictional resistance and may be bent or broken. This will lead to unsmooth rotation of the sprinkling cover 20 and shorten the using life thereof.

2. When the stopper wall 23 is located in the engaging recess of the locating rib 15, the opposite sprinkling hole 21 is inclined and deflected from the water-incoming opening 14. This will affect the sprinkling pattern of the sprinkling hole.

3. When the stopper wall 23 climbs up the locating rib 15, the engaging legs 22 are inclined and deformed so that the rotation of the sprinkling cover may be obstacled or even the engaging legs 22 may be broken.

4. The engaging legs 22 contact with the wall of the connecting hole 13 on a plane surface so as to exert additional frictional resistance on the sprinkling cover 20 against the rotation thereof.

5. The sprinkling holes 21 of the sprinkling cover 20 have monotonous patterns.

SUMMARY OF THE INVENTION

It is therefore a primary object of the present invention to provide a sprinkling seat structure for a lawn, including a circular frame seat, a connecting disk and a sprinkling rotary cover. The circular frame seat includes a circular peripheral frame and a central water-outgoing seat connected with the peripheral frame by several radial connecting ribs. A connector is disposed on one side of the water-outgoing seat for connecting with a water-incoming tube. The water-outgoing seat is formed with a water-outgoing opening for communicating with the connector. The connecting disk is formed with a central hollow downward projecting fixing boss. A free end of the fixing boss is formed with an inclined face having an annular groove. Several circular holes are formed around the fixing boss. The sprinkling rotary cover has a central sprinkling dome formed with multiple sprinkling meshes. Multiple sprinkling holes with various patterns and two opposite close holes are disposed around the sprinkling dome. The rotary cover is formed with a peripheral inclined face having multiple sprinkling meshes. Multiple circular surrounding walls are disposed on inner face of the rotary cover respectively corresponding to the sprinkling holes. A first C-shaped surrounding wall open to inner side and a second C-shaped surrounding wall open to outer side are disposed on inner face of the rotary cover respectively corresponding to the first and second close holes. The circular and C-shaped surrounding walls are connected by connecting walls. When assembled, the fixing boss of the connecting disk is inserted into the fixing hole of the frame seat with the inclined face of the fixing boss passing through and expanding the check fixing plates of the fixing hole, so that the ends of the check fixing plates resiliently abut against and engage with the annular groove of the fixing boss. A clearance is defined between the fixing boss and the wall of the fixing hole so that the rotary cover can be rotated under reduced frictional resistance.

It is a further object of the present invention to provide the above sprinkling seat structure in which in the case that the first C-shaped surrounding wall is aligned with the water-outgoing opening, the water is restricted within the inner compartment of the rotary cover and sprinkled outside from the sprinkling meshes of the central sprinkling dome. In the case that the second C-shaped surrounding wall is aligned with the water-outgoing opening, the water is restricted within the outer compartment of the rotary cover and sprinkled outside from the sprinkling meshes of the peripheral inclined face. Therefore, in addition to the sprinkling holes with various sprinkling patterns, two more sprinkling patterns are provided.

The present invention can be best understood through the following description and accompanying drawings, wherein:

DETAILED DESCRIPTION OF THE PREFERRED EMBODIMENT

Figure 1:
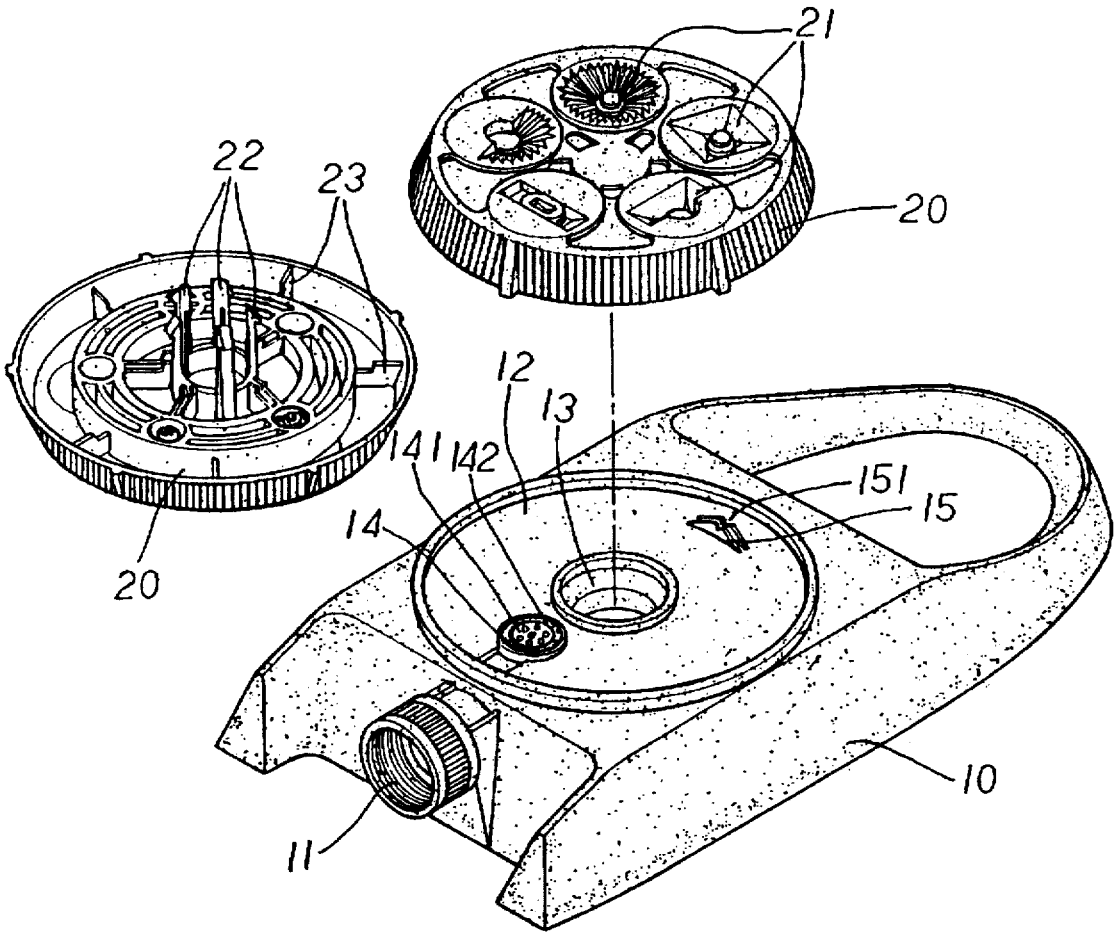
Fig. 1 Prior Art
FIG. 1 is a perspective exploded view of a conventional sprinkling seat structure for a lawn.
Figure 1:
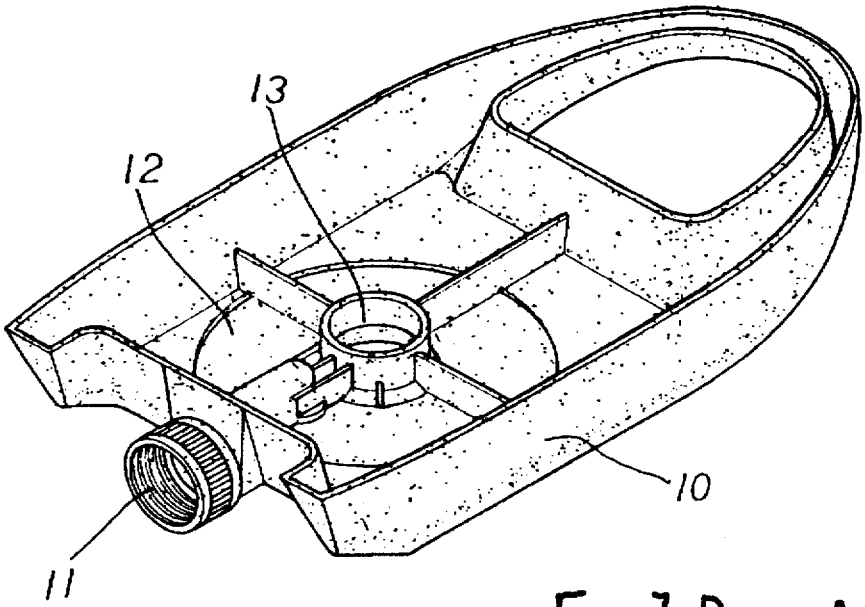
Fig. 1 Prior Art
Figure 2:
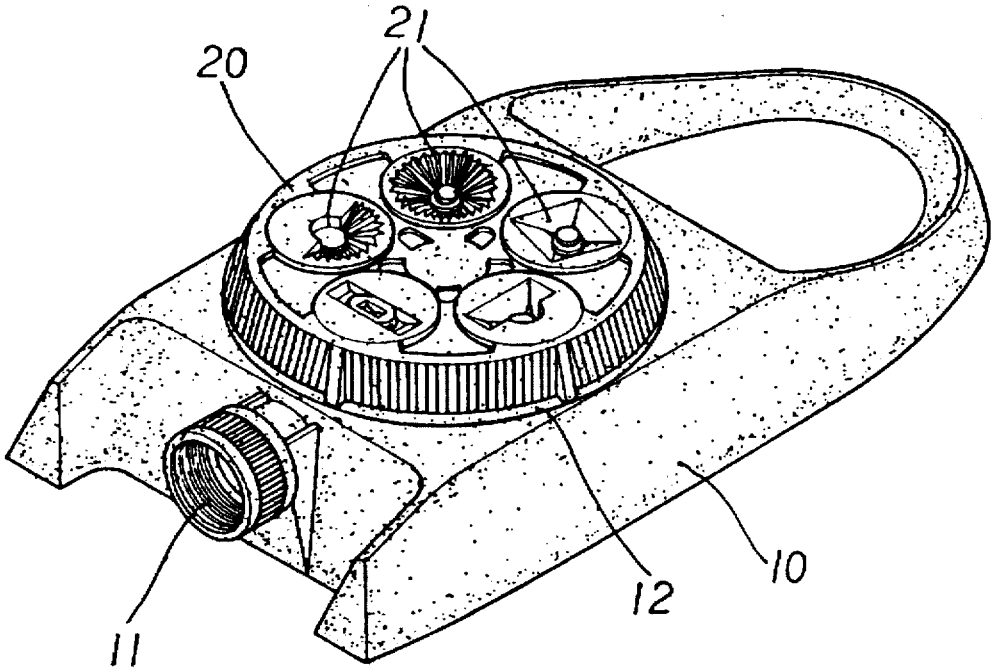
Fig. 2 Prior Art
FIG. 2 is a perspective assembled view according to FIG. 1.
Figure 3A:
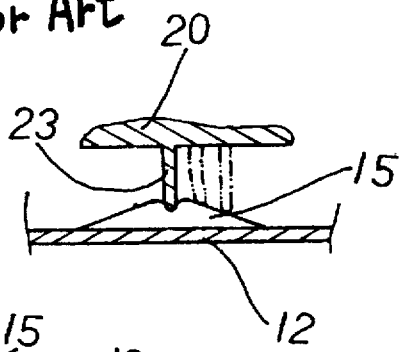
FIG. 3A is an enlarged view showing the operation of the conventional sprinkling seat structure.
Figure 3:
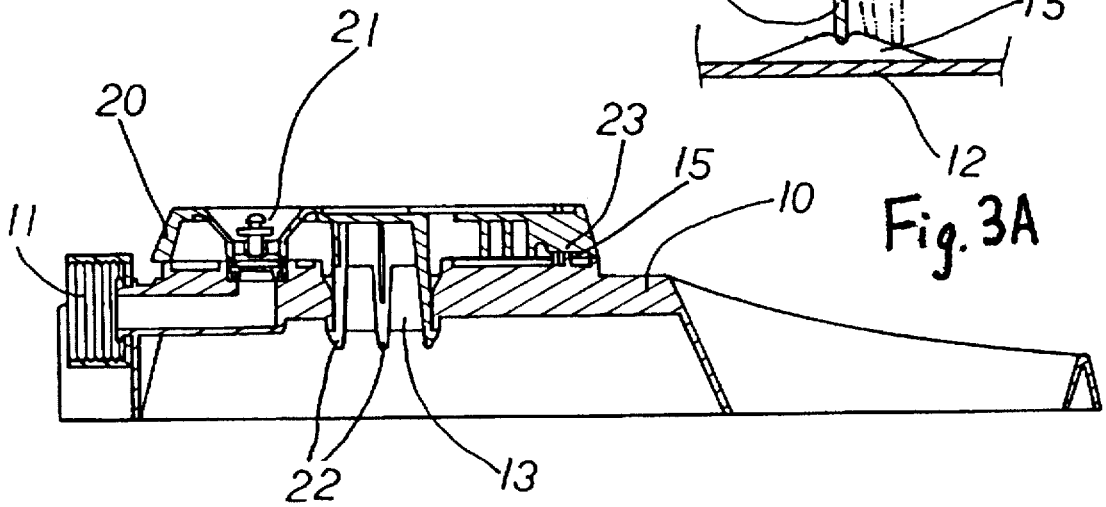
Fig. 3 Prior Art
FIG. 3 is a sectional assembled view according to FIG. 1.
Figure 4:
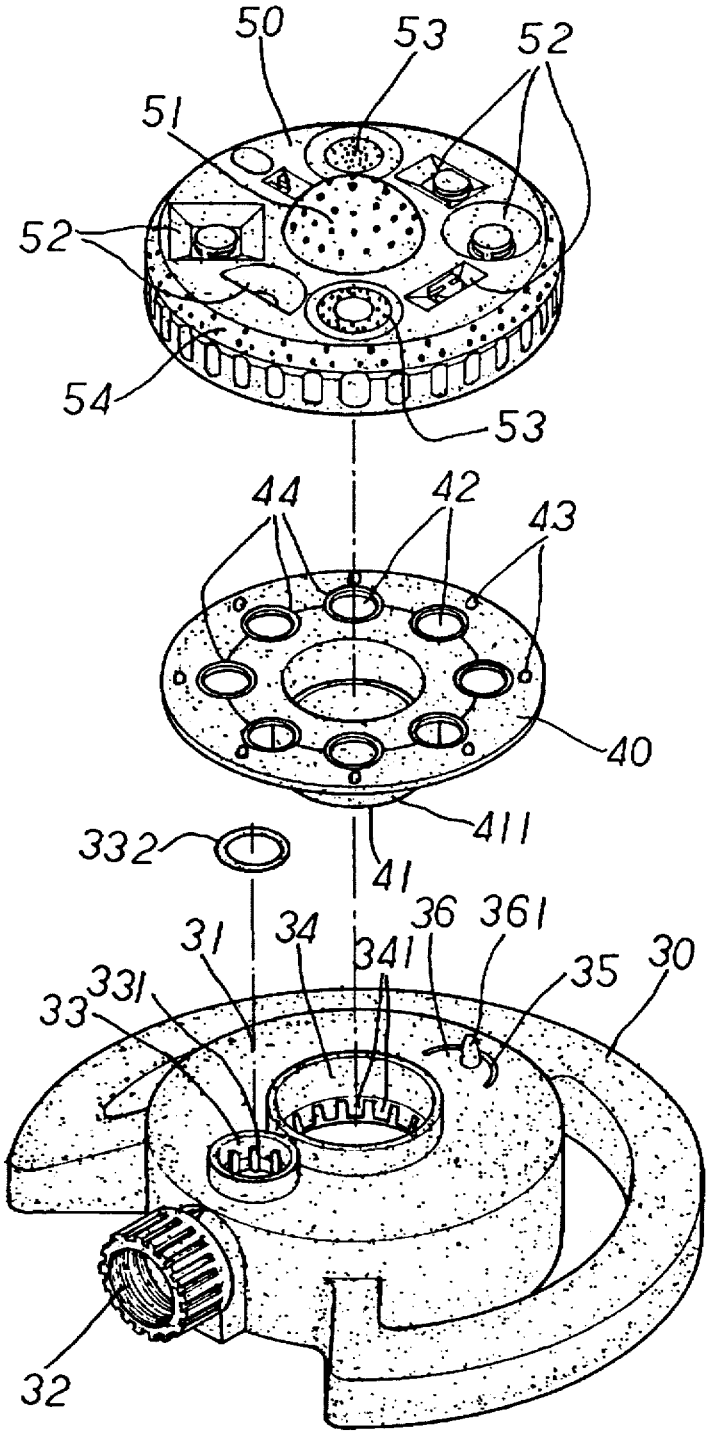
FIG. 4 is a top perspective exploded view of the present invention.
Figure 5:
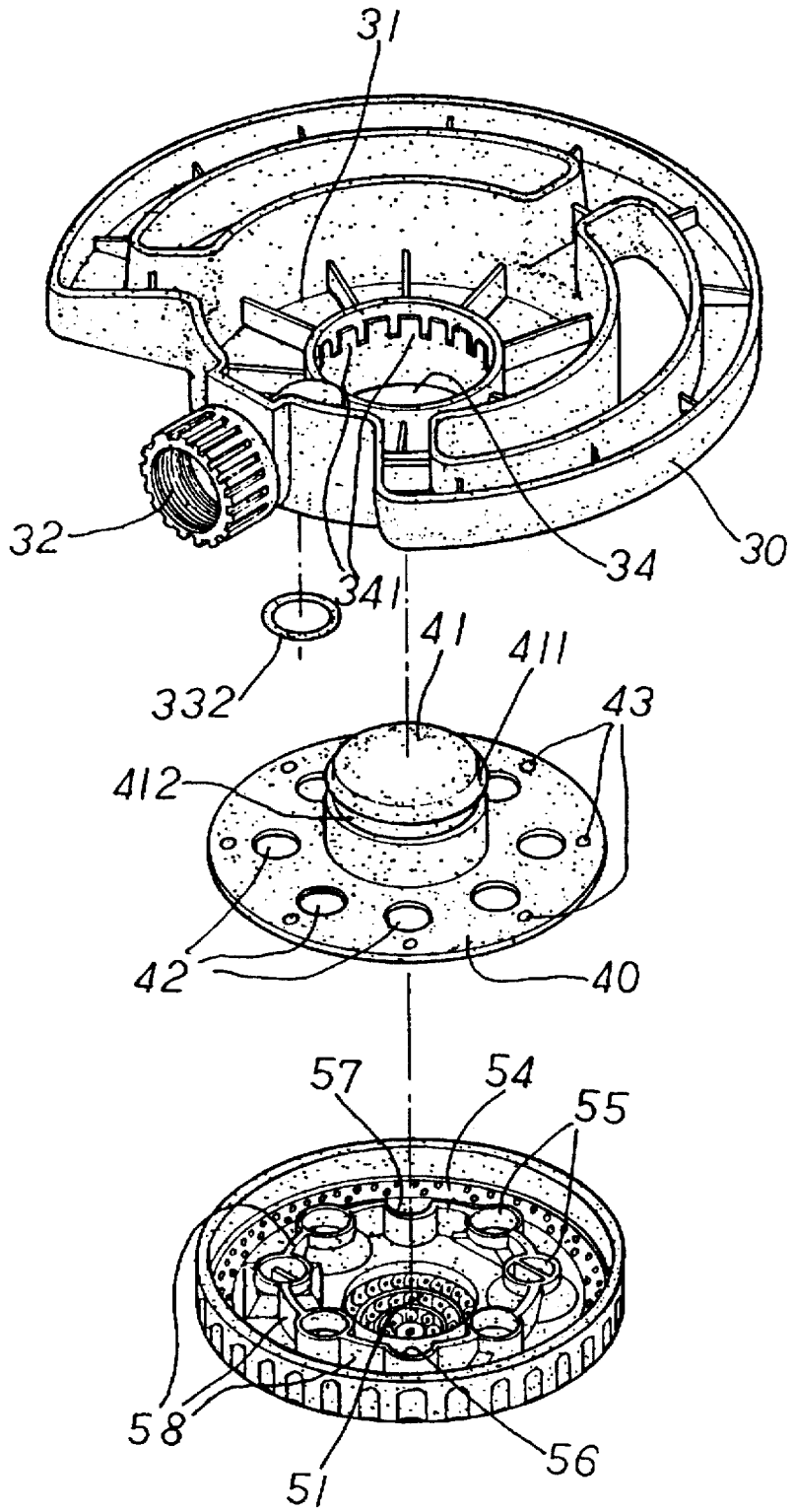
FIG. 5 is a bottom perspective exploded view of the present invention.

Please refer to FIGS. 4 and 5. The present invention includes a circular frame seat 30, a connecting disk 40 and a sprinkling rotary cover 50.

The circular frame seat 30 includes a circular peripheral frame and a central water-outgoing seat 31 connected with the peripheral frame by three radial connecting ribs. A connector 32 is disposed on one side of the water-outgoing seat 31 for connecting with a water-incoming tube. The water-outgoing seat 31 is formed with a water-outgoing opening 33 on upper surface for communicating with the connector 32. Several supporting ribs 331 are disposed on inner wall of the water-outgoing opening 33 therearound for resting a water-sealing ring 332 thereon. A central circular, fixing hole 34 is formed on the water-outgoing seat 31 adjacent to the water-outgoing opening 33. Several slightly inclined check fixing plates 341 are disposed on inner wall of the fixing hole 34 therearound. A C-shaped slit 35 is formed on one side of the fixing hole 34, defining a resilient plate 36. An upward projecting locating post 361 is formed on a free end of the resilient plate 36.

The connecting disk 40 is formed with a central hollow downward projecting fixing boss 41. A free end of the fixing boss 41 is formed with an inclined face 411 having an annular groove 412. Several equally spaced circular holes 42 are formed around the fixing boss 41. Several locating dents 43 are formed on lower surface of the connecting disk 40 respectively on outer sides of the circular holes 42 corresponding to the locating post 361. A fine thermal fusion circle 44 is formed on the upper face of the connecting disk 40 between the circular holes 42.

The sprinkling rotary cover 50 is a casing with one face open and one face close, having a central sprinkling dome 51 formed with multiple sprinkling meshes. Multiple sprinkling holes 52 with various patterns are disposed around the sprinkling dome 51, wherein a first and a second close holes 53 are opposite to each other. The rotary cover 50 is formed with a peripheral inclined face 54 around the sprinkling holes 52, which is formed with multiple sprinkling meshes. Multiple circular surrounding walls 55 are disposed on inner face of the rotary cover 50 respectively corresponding to the sprinkling holes 52. In addition, a first C-shaped surrounding wall 56 open to inner side and a second C-shaped surrounding wall 57 open to outer side are disposed on inner face of the rotary cover 50 respectively corresponding to the first and second close holes 53. The circular and C-shaped surrounding walls 55, 56, 57 are connected by connecting walls 58.

Figure 6:
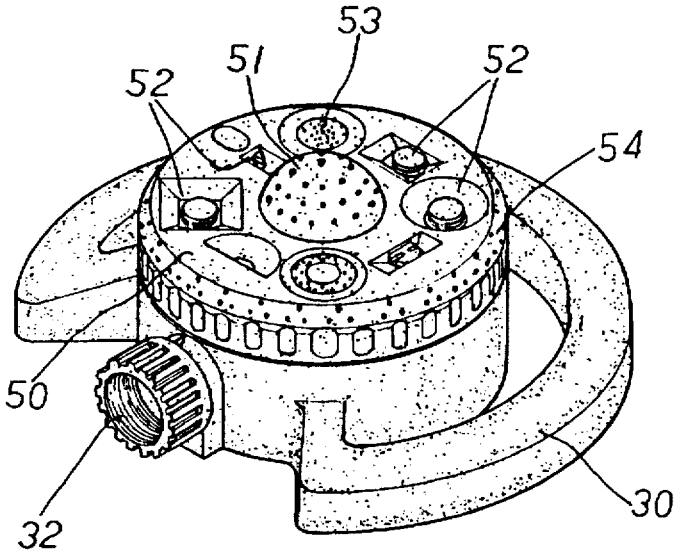
FIG. 6 is a perspective assembled view of the present invention.

When assembled, the thermal fusion circle 44 of the connecting disk 40 is aligned with the connecting walls 58 of the rotary cover 50 and thermally fused therewith by ultrasonic wave so that the circular surrounding walls 55, C-shaped surrounding walls 56, 57 and the connecting walls 58 together partition interior space of the rotary cover 50 into an outer compartment and an inner compartment. Then the fixing boss 41 of the connecting disk 40 is inserted into the fixing hole 34 of the frame seat 30. At this time, the inclined face 411 of the fixing boss 41 passes through and expands the check fixing plates 341 of the fixing hole 34. Thereafter, the ends of the check fixing plates resiliently abut against and engage with the annular groove 412 of the fixing boss 41. At this time, a clearance is defined between the fixing boss 41 and the wall of the fixing hole 34 so that the rotary cover 50 can be rotated as shorn in FIG. 6.

Figure 8:
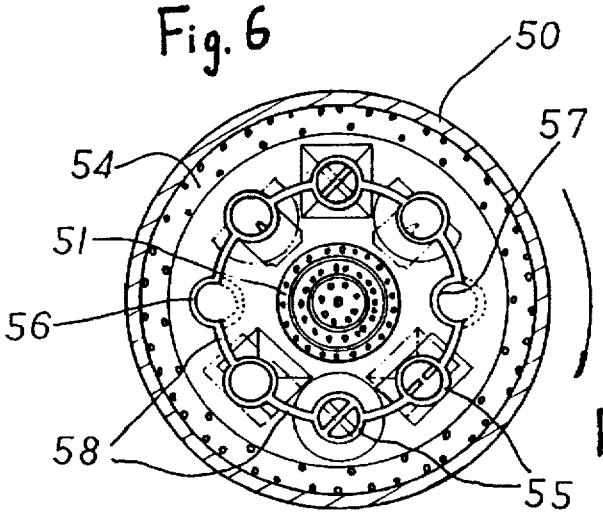
FIG. 8 is a top sectional view of the present invention, showing the rotation of the rotary cover thereof.
Figure 7:
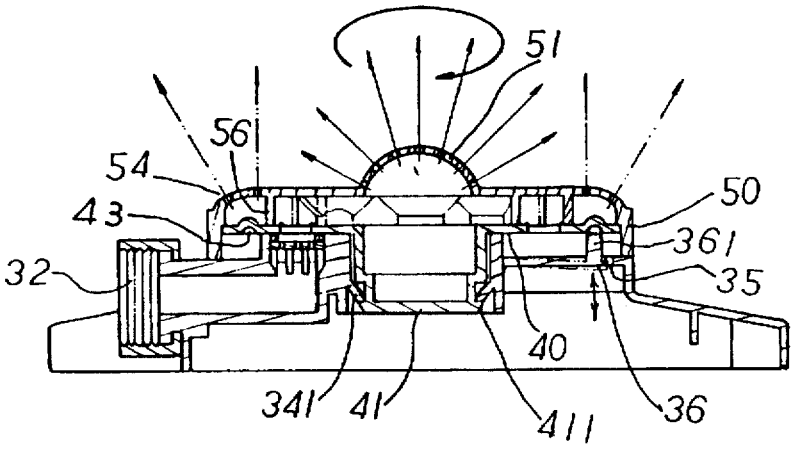
FIG. 7 is a sectional assembled view of the present invention, showing the various sprinkling patterns.

Please refer to FIGS. 7 and 8. When the rotary cover 50 is rotated in a direction of the arrow to align one of the circular holes 42 of the connecting disk 40 with the water-outgoing opening 35 of the water-outgoing seat 30, the locating post 361 of the resilient plate 36 is resiliently fitted into the locating dent 43 beside the circular hole 42 as shown by tile phantom line and arrow of FIG. 7. The connector 32 of the frame seat 30 is then connected with the water-incoming tube so that the water can flow into the water-outgoing opening 33 of the water-outgoing seat 31 to be sprinkled outside from the sprinkling holes 52 and the sprinkling meshes of the central sprinkling dome 51 and the peripheral inclined face 54 of the rotary cover 50.

Please refer to FIG. 7. In the case that the first C-shaped surrounding wall 56 and the first close hole 53 are aligned with the water-outgoing opening 33, the water is restricted within the inner compartment of the rotary cover 50 and sprinkled outside from the sprinkling meshes of the central sprinkling dome 51. In the case that tile second C-shaped surrounding wall 57 and the second close hole 53 are aligned with the water-outgoing opening 33, the water is restricted within the outer compartment of the rotary cover 50 and sprinkled outside from the sprinkling meshes of the peripheral inclined face 57. Therefore, in addition to the sprinkling holes with various sprinkling patterns, two more sprinkling patterns are provided.

The above embodiment is only an example of the present invention and the scope of the present invention should not be limited to the example. Any modification or variation derived from the example should fall within the scope of the present invention.

What is claimed is:

1. A sprinkling seat structure for a lawn, comprising a circular frame seat, a connecting disk and a sprinkling rotary cover, wherein:

the circular frame seat includes a circular peripheral frame and a central water-outgoing seat connected with the peripheral frame by several radial connecting ribs, a connector being disposed on one side of the water-outgoing seat for connecting with a water-incoming tube, the water-outgoing seat being formed with a water-outgoing opening on upper surface for communicating with the connector, several supporting ribs being disposed on inner wall of the water-outgoing opening therearound for resting a water-sealing ring thereon, a central circular fixing hole being formed on the water-outgoing seat adjacent to the water-outgoing opening, several slightly inclined check fixing plates being disposed on inner wall of the fixing hole therearound, a C-shaped slit being formed on one side of the fixing hole, defining a resilient plate, an upward projecting locating post being formed on a free end of the resilient plate;

the connecting disk is formed with a central hollow downward projecting fixing boss, a free end of the fixing boss being formed with an inclined face having an annular groove, several equally spaced circular holes being formed around the fixing boss, several locating dents being formed on lower surface of the connecting disk respectively on outer sides of the circular holes corresponding to the locating post, a fine thermal fusion circle being formed on the upper face of the connecting disk between the circular holes; and the sprinkling rotary cover is a casing with one face open and one face close, having a central sprinkling dome formed with multiple sprinkling meshes, multiple sprinkling holes with various patterns being disposed around the sprinkling dome, wherein a first and a second close holes are opposite to each other, the rotary cover being formed with a peripheral inclined face around the sprinkling holes, which is formed with multiple sprinkling meshes, multiple circular surrounding walls being disposed on inner face of the rotary cover respectively corresponding to the sprinkling holes, a first C-shaped surrounding wall open to inner side and a second C-shaped surrounding wall open to outer side being disposed on inner face of the rotary cover respectively corresponding to the first and second close holes, the circular and C-shaped surrounding walls being connected by connecting walls, whereby when assembled, the thermal fusion circle of the connecting disk is aligned with the connecting walls of the rotary cover and thermally fused therewith by ultrasonic wave so that the circular surrounding walls, C-shaped surrounding walls and the connecting walls together partition interior space of the rotary cover into an outer compartment and an inner compartment and then the fixing boss of the connecting disk is inserted into the fixing hole of the frame seat, the inclined face of the fixing boss passing through and expanding the check fixing plates of the fixing hole, so that the ends of the check fixing plates resiliently abut against and engage with the annular groove of the fixing boss, a clearance being defined between the fixing boss and the wall of the fixing hole so that the rotary cover can be rotated, and when the rotary cover is rotated to align one of the circular holes of the connecting disk with the water-outgoing opening of the water-outgoing seat, the locating post of the resilient plate being resiliently fitted into the locating dent beside the circular hole, the connector of the frame seat being then connected with the water-incoming tube so that the water can flow into the water-outgoing opening of the water-outgoing seat to be sprinkled outside from the sprinkling holes and the sprinkling meshes of the central sprinkling dome and the peripheral inclined face of the rotary cover.

2. A sprinkling seat structure as claimed in claim 1, wherein in the case that the first C-shaped surrounding wall and the first close hole are aligned with the water-outgoing opening, the water is restricted within the inner compartment of the rotary cover and sprinkled outside from the sprinkling meshes of the central sprinkling dome, while in the case that the second C-shaped surrounding wall and the second close hole are aligned with the water-outgoing opening, the water is restricted within the outer compartment of the rotary cover and sprinkled outside from the sprinkling meshes of the peripheral inclined face.

* * * * *